US006471559B2

(12) United States Patent
Kashima

(10) Patent No.: US 6,471,559 B2
(45) Date of Patent: Oct. 29, 2002

(54) OUTBOARD MOTOR COOLING AND EXHAUST SYSTEM

(75) Inventor: Yukinori Kashima, Hamamatsu (JP)

(73) Assignee: Sanshin Kogyo Kabushiki Kaisha (JP)

( * ) Notice: Subject to any disclaimer, the term of this patent is extended or adjusted under 35 U.S.C. 154(b) by 0 days.

(21) Appl. No.: 09/982,560

(22) Filed: Oct. 16, 2001

(65) Prior Publication Data

US 2002/0049014 A1 Apr. 25, 2002

Related U.S. Application Data

(63) Continuation of application No. 09/444,903, filed on Nov. 22, 1999, now Pat. No. 6,302,754.

(30) Foreign Application Priority Data

Nov. 20, 1998 (JP) ..... 10-338279

(51) Int. Cl.[7] ..... B63H 21/10
(52) U.S. Cl. ..... 440/88; 60/321
(58) Field of Search ..... 440/88, 89; 123/41.31, 123/41.72, 41.74; 60/321, 323

(56) References Cited

U.S. PATENT DOCUMENTS 3,431,882 A 3/1969 Irgens
3,994,129 A 11/1976 Sakurai et al.
4,346,676 A 8/1982 Tyner
4,621,595 A 11/1986 Suzuki
4,787,344 A 11/1988 Okumura et al.
4,951,465 A 8/1990 Torigai
5,003,934 A 4/1991 Gubon et al.
5,109,809 A 5/1992 Fujimoto
5,476,402 A 12/1995 Nakai et al. ..... 440/89
5,752,866 A 5/1998 Takahashi et al. ..... 440/88
5,803,023 A 9/1998 Takahashi et al. ..... 440/88
5,893,783 A 4/1999 Hiraoka et al.

*Primary Examiner*—Jesus D. Sotelo
(74) *Attorney, Agent, or Firm*—Knobbe, Martens Olson & Bear, LLP

(57) ABSTRACT

An outboard motor features a v-type internal combustion engine having a generally vertically extending crankshaft. Exhaust gases from combustion chambers are routed through a set of exhaust manifolds positioned within the valley defined by the two banks of cylinders. The exhaust flow is merged within a passage formed in the cylinder block prior to passing the exhaust flow into a passage formed within an exhaust guide plate to which the engine is mounted. The merged flow passage is positioned to allow a compact outboard motor construction. The motor also features a cooling pattern by which the exhaust manifold runners, the exhaust manifold, the cylinder head, the valley and the cylinders are cooled in that order.

27 Claims, 7 Drawing Sheets

OUTBOARD MOTOR COOLING AND EXHAUST SYSTEM

PRIORITY INFORMATION

This application is a continuation of U.S. application Ser. No. 09/444,903, filed Nov. 22, 1999, issued as U.S. Pat. No. 6,302,754 on Oct. 16, 2001. That application was based on and claimed priority to Japanese Patent Application Nos. 10-338,279, filed Nov. 20, 1998, the entire contents of which were expressly incorporated by reference.

BACKGROUND OF THE INVENTION

1. Field of the Invention

The present invention principally relates to four-cycle engines for powering outboard motors. More particularly, the present invention relates to cooling and exhaust systems for such engines associated with outboard motors.

2. Description of the Related Art

Outboard motors are often used to power watercraft. The engines are attached to the back of the watercraft and serve to propel as well as push the watercraft. The engines include powerheads that often extend above a transom of the water. Because the engines are not substantially shielded from the front, the engines can be a large source of wind drag. Accordingly, efforts have been made to decrease the size of the outboard motors while not sacrificing engine performance. One way of decreasing the size of outboard motors employing v-type engines is to decrease the spread of the cylinder banks or to decrease the length of the cylinder banks.

A limitation on narrowing the cylinder banks involves the construction of most exhaust systems. The v-type engines currently used in outboard motors often include an exhaust system that routes the exhaust gases through the powerhead and into the drive shaft housing prior to expelling the gases to either the atmosphere or the body of water in which the watercraft is operating. These exhaust systems often include a pair of exhaust manifolds that separately funnel the exhaust gases from selected cylinders through an exhaust guide plate and into the balance of the exhaust system. The manifolds must be properly sized to allow sufficient exhaust gases to flow through the manifolds such that exhaust gas blow down removes sufficient exhaust gases from the combustion chamber. Accordingly, narrowing the valley between the cylinder banks on v-type engines could adversely affect performance due to the decrease in the exhaust manifold cross section.

Additionally, a seal must be maintained between the cylinder block and the exhaust guide plate to avoid gas leakage. Forming a proper seal, however, proves difficult if the sealed surface area becomes too large. Additionally, the cost of materials increases with the increases in the surface area to be sealed. The increase in materials cost is disadvantageous both upon initial sale as well as while completing repair work.

SUMMARY OF THE INVENTION

Accordingly, an improved exhaust and cooling system is desired whereby the engine size can be reduced without substantially sacrificing performance. In addition, the exhaust system should be designed for an efficient and cost effective manufacture of the outboard motors.

One aspect of the present invention involves an outboard motor comprising an internal combustion engine. An exhaust guide plate is positioned generally below the internal combustion engine and comprises an exhaust guide passage. The internal combustion engine comprises a generally vertically extending crankshaft and a cylinder block comprising a first cylinder bank and a second cylinder bank. The first cylinder bank and the second cylinder bank are inclined relative to each another with the first cylinder bank comprising a first lower cylinder and the second cylinder bank comprising a second lower cylinder. A first cylinder head assembly encloses the first lower cylinder and a second cylinder head encloses the second lower cylinder. The first cylinder head assembly comprises a first exhaust port and a first exhaust runner corresponding to the first lower cylinder and the second cylinder head assembly comprises a second exhaust port and a second exhaust runner corresponding to the second lower cylinder. The first exhaust runner extends between the first exhaust port and a first generally vertically extending exhaust manifold. The second exhaust runner extends between the second exhaust port and a second generally vertically extending exhaust manifold. A first connecting exhaust conduit communicates with the first exhaust manifold and a second connecting exhaust conduit communicates with the second exhaust manifold. The first connecting exhaust conduit extends toward the cylinder block and joins a first end of a first passage formed within the cylinder block. The second connecting exhaust conduit extends toward the cylinder block and joins a first end of a second passage formed within the cylinder block. The first end of the first passage is disposed vertically higher on the cylinder block than the first end of the second passage. The first and second passages merge within the cylinder block into an exhaust discharge and the exhaust discharge is coupled to the exhaust guide passage.

Another aspect of the present invention involves an outboard motor comprising an internal combustion engine. An exhaust guide plate is positioned generally below the internal combustion engine and comprises an exhaust guide passage. The internal combustion engine comprises a generally vertically extending crankshaft and a cylinder block having a pair of cylinder banks inclined relative to one another. Each of the pair of cylinder banks includes at least one cylinder and a corresponding exhaust port. An exhaust runner is in selective communication with each exhaust port. The engine comprises two exhaust manifolds that extend in generally vertical directions. The cylinder block also has a pair of passages formed therein that are in communication with the exhaust manifolds. The passages merge within the cylinder block into an exhaust discharge. The exhaust discharge is in communication with the exhaust guide passage. The engine further comprises a flywheel attached to the crankshaft and having an outer diameter. The exhaust discharge of the cylinder block is positioned within the cylinder block such that the outer diameter overlaps at least a portion of the exhaust discharge when viewed from the top.

A further aspect of the present invention involves an outboard motor comprising a first cylinder bank and a second cylinder bank, the first cylinder bank and the second cylinder bank being inclined relative to one another and jointly forming at least a portion of a cylinder block. A crankcase cover is connected to a portion of the cylinder block and at least partially defines a crankcase chamber. A generally vertically extending crankshaft extends through the crankcase chamber between the crankcase cover and the cylinder block. A first cylinder head assembly is attached to the first cylinder bank and a second cylinder head assembly is attached to the second cylinder bank. A first exhaust manifold is connected to the first cylinder head assembly and a second exhaust manifold is connected to the second cylinder head assembly. An exhaust passage is formed in the cylinder block and comprises a first branch, a second branch and a convergent portion that combines the first branch and the second branch. The first and second exhaust manifolds separately communicate with the first and second branches respectively. The first and second exhaust manifolds communicate with the first and second branches and the first and second exhaust manifolds are at least partially formed in the first and second cylinder head assemblies respectively.

BRIEF DESCRIPTION OF THE DRAWINGS

The present invention will now be described with reference to the drawings of a preferred embodiment, which embodiment is intended to illustrate, but not to limit, the present invention, and in which figures.

DETAILED DESCRIPTION OF A PREFERRED EMBODIMENT OF THE PRESENT INVENTION

Figure 1:
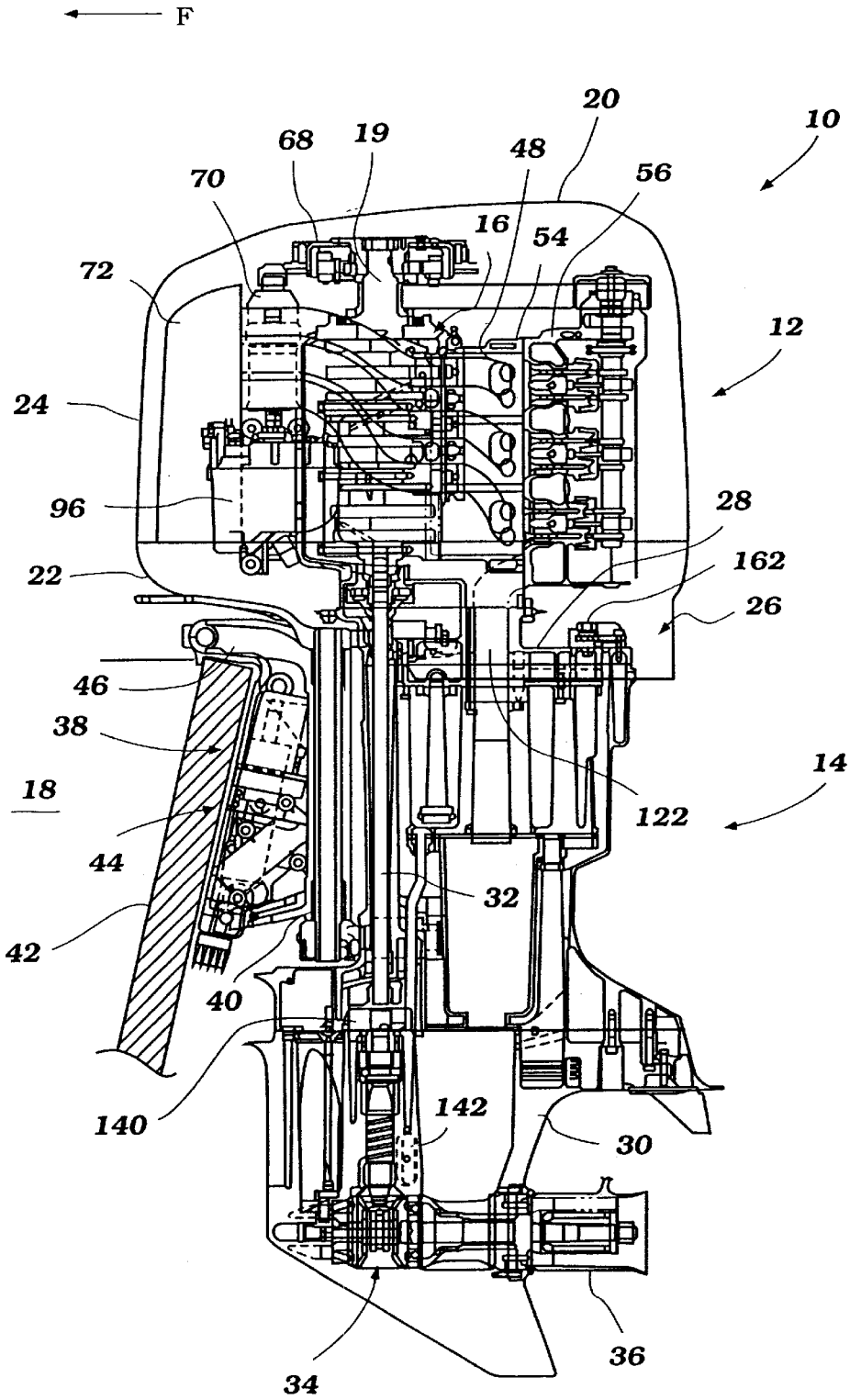
FIG. 1 is a wire frame side elevation view showing an outboard motor configured in accordance with certain features, aspects and advantages of the present invention.

With reference initially to FIG. 1, an outboard motor, indicated generally by the reference numeral 10, is illustrated therein. The illustrated outboard motor advantageously incorporates an exhaust and cooling system configured in accordance with certain features, aspects and advantages of the present invention. The configuration results in a compact motor construction as well as a simplified assembly process. Although the exhaust and cooling system is described below in connection with the illustrated outboard motor, it should be understood that certain features, aspects and advantages of the present invention can also be used in other application, such as, for example, but without limitation, sterndriven watercraft and a variety of other land-based vehicle and engine applications.

The illustrated outboard motor 10 generally comprises a power head 12 and a drive shaft housing 14. The power head 12 preferably contains an internal combustion engine 16 that is used to power a watercraft 18 to which the outboard motor 10 is mounted. As will be described, the engine preferably is mounted such that an output shaft 19 of the motor (i.e., a crankshaft) extends in a generally vertical direction when the motor is placed in an operational position.

The power head 12 includes a protective cowling 20, which surrounds the engine 16 and generally comprises both a lower tray portion 22 and a removable main cover portion 24. The lower tray portion 22 and the main cover portion 24 preferably are connected to one another such that the main cover portion 24 can be pivoted or otherwise removed to allow access to the engine 16 contained within the cowling 20. More preferably, the two components 22, 24 are sealed together to substantially protect the engine 16 from excess water contact.

The illustrated lower tray portion 22 contains an exhaust guide plate 28, which will be described in more detail below. In the illustrated arrangement, the engine 16 is mounted to the exhaust guide plate 28 and thereby is mounted to the balance of the motor 10.

An apron 26 connects the illustrated power head 12 to the drive shaft housing 14. The apron 26 is positioned below the tray portion 22 in a manner well known to those of ordinary skill in the art The drive shaft housing 14 depends from the apron 26 and terminates in a lower unit 30. A drive shaft 32 extends through the housing 14 and transmits the rotational movement of the crankshaft 19 to a transmission 34 that is positioned within the lower unit 30. The particular orientation of the illustrated engine 16 facilitates coupling of the drive shaft 32 to the crankshaft 19.

The transmission 34 desirably is a forward/neutral/reverse-type transmission so as to drive the watercraft 18 in any of these operational states. The transmission 34 selectively establishes a driving condition of a propulsion device 36. In the illustrated embodiment, the propulsion device 36 is a propeller. Of course, any other suitable propulsion device can also be used. For example, but without limitation, the propulsion device 36 could be a jet pump unit.

As is generally known to those of ordinary skill in the art, the present outboard motor 10 is attached to the watercraft 18 using a clamp and swivel bracket 38. Specifically, the bracket 38 includes a swivel shaft 40 that extends in a generally vertical direction (i.e., generally parallel to the drive shaft 32) and allows the motor 10 to swivel about a turning axis. Steering movement occurs about this turning axis. A steering arm (not shown) can be connected to an upper end of the swivel shaft 40 and can extend in a forward direction for steering of the outboard motor 10.

The bracket 38 also allows the outboard motor 10 to be clamped or otherwise secured to the watercraft 18. Specifically, the clamping portion of the bracket 38 is adapted to attach to a transom 42 of the associated watercraft 18. The bracket 38 is arranged on the transom 42 at a location that supports the outboard motor 10 in a generally upright position and at a location where the propulsion unit 36 lies at least partially submerged beneath the surface of the body of water in which the watercraft is being operated.

The bracket 38 permits adjustment of a trim position of the outboard motor 10 and allows the outboard motor 10 to be tilted up for transportation or storage. For this purpose, a tilt and trim cylinder assembly 44 desirably moves the outboard motor about a pivot shaft 46 of the bracket 38. This permits the outboard motor 10 to move within a normal range of positions relative to the transom 42 (i.e., between a generally upright position to a full tilt-up position).

Figure 2:
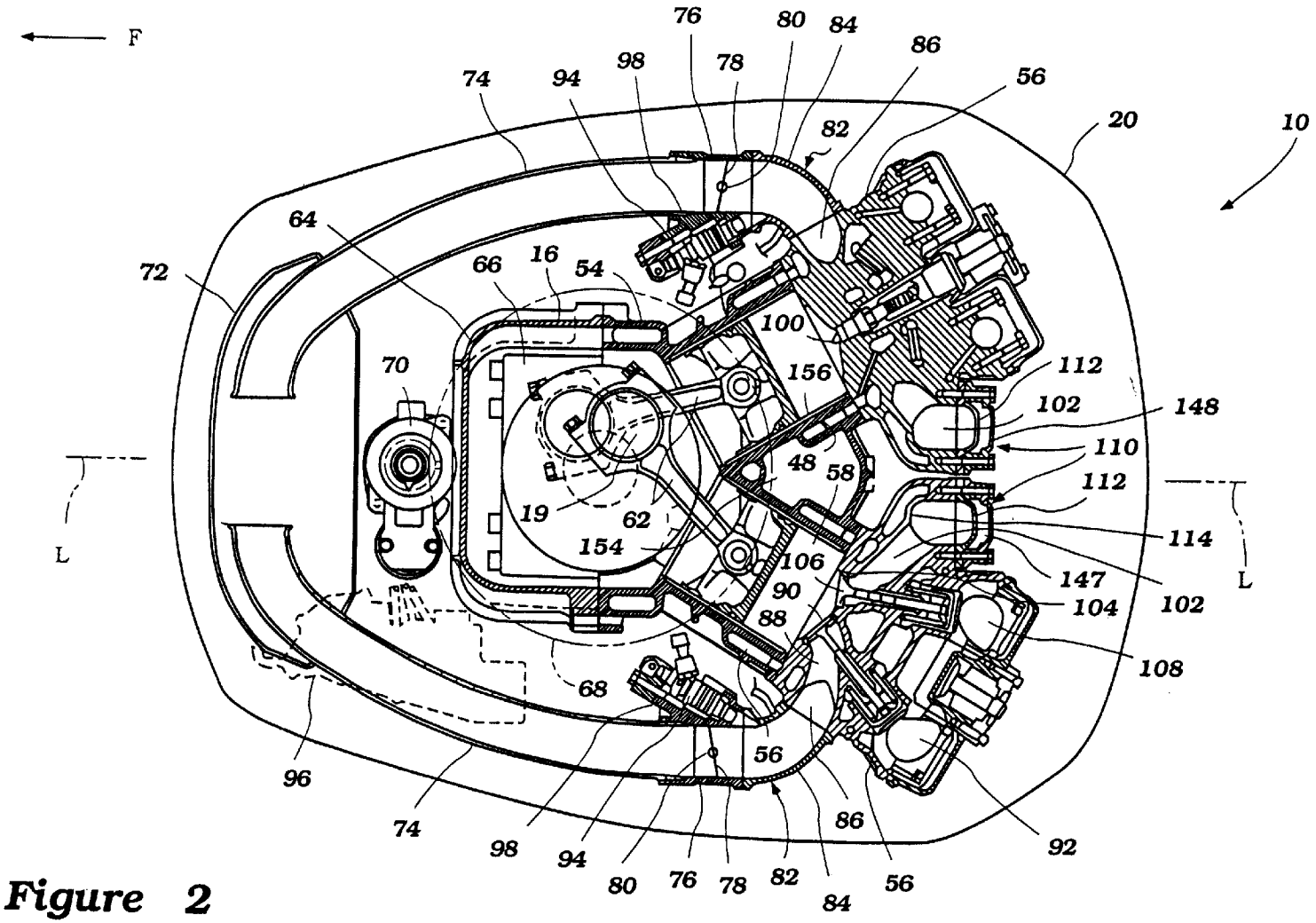
FIG. 2 is a sectioned top plan view of a portion of the outboard motor of FIG. 1.

With reference now to FIG. 2, the illustrated engine 16 is preferably of a six-cylinder, four-cycle engine. More preferably, the engine 16 is arranged in a V-6 configuration, meaning that the engine 16 has six cylinders 48 arranged in two distinct inclined cylinder banks of three cylinders 48, which two banks 50, 52, together form at least a portion of a cylinder block 54. In some arrangements, the engine 16 can have a greater or lesser number of cylinders 48, such as two, four, eight or more. Additionally, certain aspects of the present invention can also be used with engines having other cylinder arrangements, for example, but without limitation, in-line.

In the illustrated arrangement, a set of cylinder head assemblies 56 are connected to the two banks 50, 52 that form at least a portion of the cylinder block 54. The cylinder head assemblies may include lubricant return ports 57 in some applications (i.e., where lubrication is needed in cylinder head assembly for camshafts). Beneath the cylinder head assemblies 56 lie a set of combustion chambers 58 that are defined by the recesses formed in a lower surface of the cylinder head assemblies 56, the cylinders 48 and a set of pistons 60.

The pistons 60 are movably positioned in each cylinder 48 and are adapted for reciprocating movement therein. Each of the pistons 60 is connected to a first end of a corresponding connecting rod 62. A second end of the connecting rod 62 is rotatably connected to a throw of the crankshaft 19. Thus, reciprocal movement of the pistons is transposed into rotational movement of the crankshaft 19.

The crankshaft 19 preferably is journaled for rotation with respect to the cylinder block 54. A crankcase cover 64 engages an end of the cylinder block 54 generally opposite the cylinder heads 56 and, together with the cylinder block 54, defines a crankcase chamber 66 enclosing the crankshaft 19.

As continued reference to FIGS. 1 and 2, a flywheel 68 is positioned above the illustrated cylinder block 54 and is adapted to rotate with the crankshaft 19. A starter motor 70 preferably is positioned adjacent the crankcase 66. The starter motor 70 drives a gear that selectively engages the flywheel 68 to start the engine, as is well known in the art. It is to be understood that although the flywheel 68 is disposed at the top of the illustrated engine 16, other arrangements are also possible. For example, the flywheel 68 can be positioned at the bottom of the engine 16.

Figure 3:
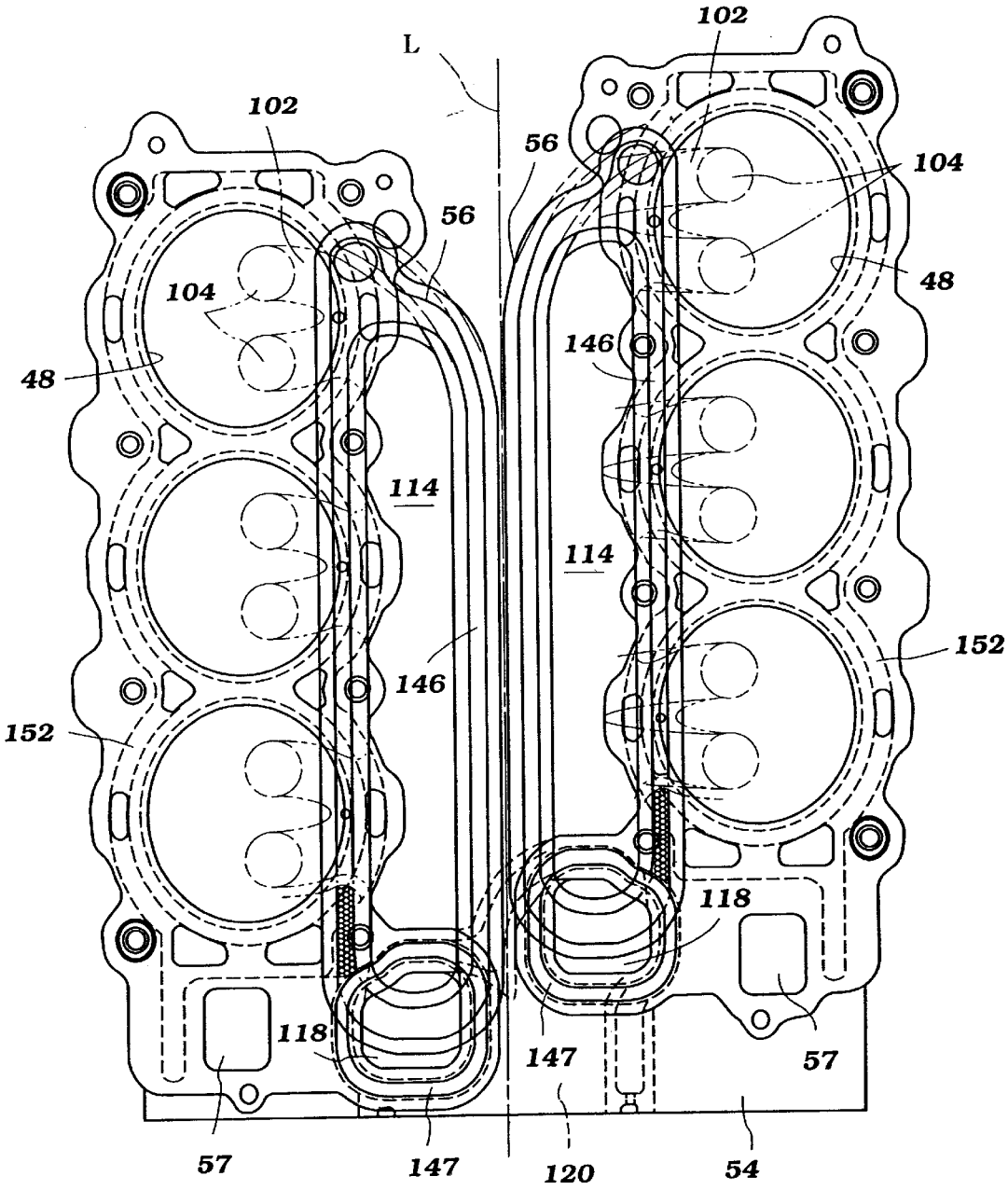
FIG. 3 is a side elevation view of a cylinder head and exhaust manifold arrangement of the engine of the outboard motor of FIG. 1.

With reference now to FIGS. 2 and 3, an induction and fuel delivery system is provided for delivering fuel to each combustion chamber 58 for combustion therein. Generally, air is drawn by the induction system (i.e., as by suction caused by operation of the engine) through a vent (not shown) formed in the cowling 20. Preferably, the vent (not shown) is formed in an upper and rearwardly facing portion of the main cover portion 24 to reduce the induction of water or mist from the body of water in which the watercraft 18 is being operated.

From within the cowling 20, air is drawn into the balance of the induction system through an air intake chamber 72, or air silencer, positioned in a forward portion of the illustrated cowling 20. The air drawn from within the cowling 20 enters the illustrated intake chamber 72 through an air inlet (not shown) formed near the top of the intake chamber 72.

A plurality of intake pipes 74 lead from the intake chamber 72 for directing air from the intake chamber 72 to the combustion chambers 58 of the engine 16. In the illustrated arrangement, one intake pipe 74 is provided for each cylinder 48 such that only one intake pipe 74 communicates with any one combustion chamber 48. The illustrated intake pipes 74 wrap around a portion of the cylinder block 54 and feature a configuration substantially corresponding to a shape of the inside of the upper motor cowling 24. The intake pipes 74 and the intake chamber 72 can be made of resin or of aluminum by a diecasting method. These components 72, 74 also can be integrally formed (i.e., formed as a unitary piece).

A throttle body 76 is interposed between the intake chamber 72 and each combustion chamber 58. Preferably, the throttle bodies 76 are positioned proximate the cylinder head 56 as illustrated in FIG. 2. As illustrated, a throttle valve 78 can regulate flow through the throttle body 76 by rotating inside the throttle body 76 about a throttle shaft 80. Thus, the rotation of the throttle valve 78 acts to regulate a flow of air through the throttle body 76.

The throttle bodies 76 of each cylinder bank 50, 52 communicate with an intake manifold 82 associated with that cylinder bank 50, 52 of the engine 16. More specifically, each throttle body 76 communicates with an intake runner 84 of the intake manifold. The intake runner 84 leads to intake passages 86 formed in the cylinder head 56, which intake passages 86 lead to the combustion chambers 58 through corresponding intake ports 88.

An the illustrated engine 16, two intake ports 88 are associated with each combustion chamber 58. An intake valve 90 is supported by the cylinder head assembly 56 and is adapted to regulate the flow through each intake passage 86 and corresponding intake port 88. An intake valve camshaft 92 is journaled within the cylinder head assembly 56 and actuates the intake valve 90 in a reciprocating manner, as is known in the art.

A fuel injector 94 communicates with the illustrated induction system downstream of the throttle valve 78 and upstream of the intake ports 88 to supply fuel to the air being drawn through the induction system. Fuel is delivered to the fuel injectors 94 from a fuel tank (not shown) by any suitable fuel pumping arrangement. The chosen pumping arrangement in the illustrated configuration includes a vapor separator 96 that separates air from the fuel prior to introduction to the fuel injector 94. Of course, the fuel injectors 94 can be positioned to inject fuel directly into the combustion chamber 58 (i.e., direct injection) rather than indirectly through the induction system (i.e., indirect injection) and can be positioned in other locations along the induction system. Moreover, certain features, aspects and advantages of the present invention can be used with carbureted engines as well.

With continued reference to FIG. 2, the illustrated fuel injectors 94 are provided one per cylinder 48. Of course, two or more can be used for a single cylinder where desired. The illustrated fuel injectors 94 are secured to the induction system with fuel injector holders 98 that are formed integrally with the throttle bodies 76. The illustrated fuel injector holders 98 are formed on a side adjacent the cylinder block 54, but need not be. The fuel injector 94 preferably is positioned along the throttle body 76 so that its spray axis is generally parallel to an axis of the corresponding cylinder 48. Such a mounting arrangement advantageously reduces the lateral dimension of the outboard motor 10.

Having introduced an air/fuel charge into the combustion chamber 56, a suitable ignition system ignites the charge within each combustion chamber 56. Such ignition systems are well known in the art and may include a spark plug 100 extending into the combustion chamber 56.

Following combustion, the exhaust gases must be discharged from the combustion chambers 56 to a point external of the outboard motor 10. Accordingly, the illustrated outboard motor 10 includes an exhaust system that will now be described.

The cylinder heads 56 preferably include exhaust passages 102 that allow exhaust gases to exit the combustion chamber 58 through corresponding exhaust ports 104. In the illustrated engine 16, two exhaust ports 104 are associated with each combustion chamber 58. An exhaust valve 106 is supported by the cylinder head assembly 56 and regulates, flow through each exhaust passage 102 and exhaust port 104. An exhaust valve camshaft 108 is journaled within the cylinder head 56 and is adapted to actuate the exhaust valve 106 in a reciprocating manner similar to that of the intake valve 90 and intake valve camshaft 92.

With reference now to FIGS. 2–5, the exhaust passages 102 form runners of an exhaust manifold 110. As illustrated, each cylinder bank 50, 52 preferably has a dedicated exhaust manifold 110. A portion of the cylinder head assemblies 56 and a set of manifold covers 112 advantageously define the illustrated exhaust manifolds 110. Of course, a single manifold cover 112 can be used in some applications. More specifically, an exhaust manifold passage 114 that extends in a generally vertical direction is defined in this manner. The passage 114 collects the exhaust gases from each of the combustion chambers 58 flowing through the passages 102.

Figures 4A, 4B:
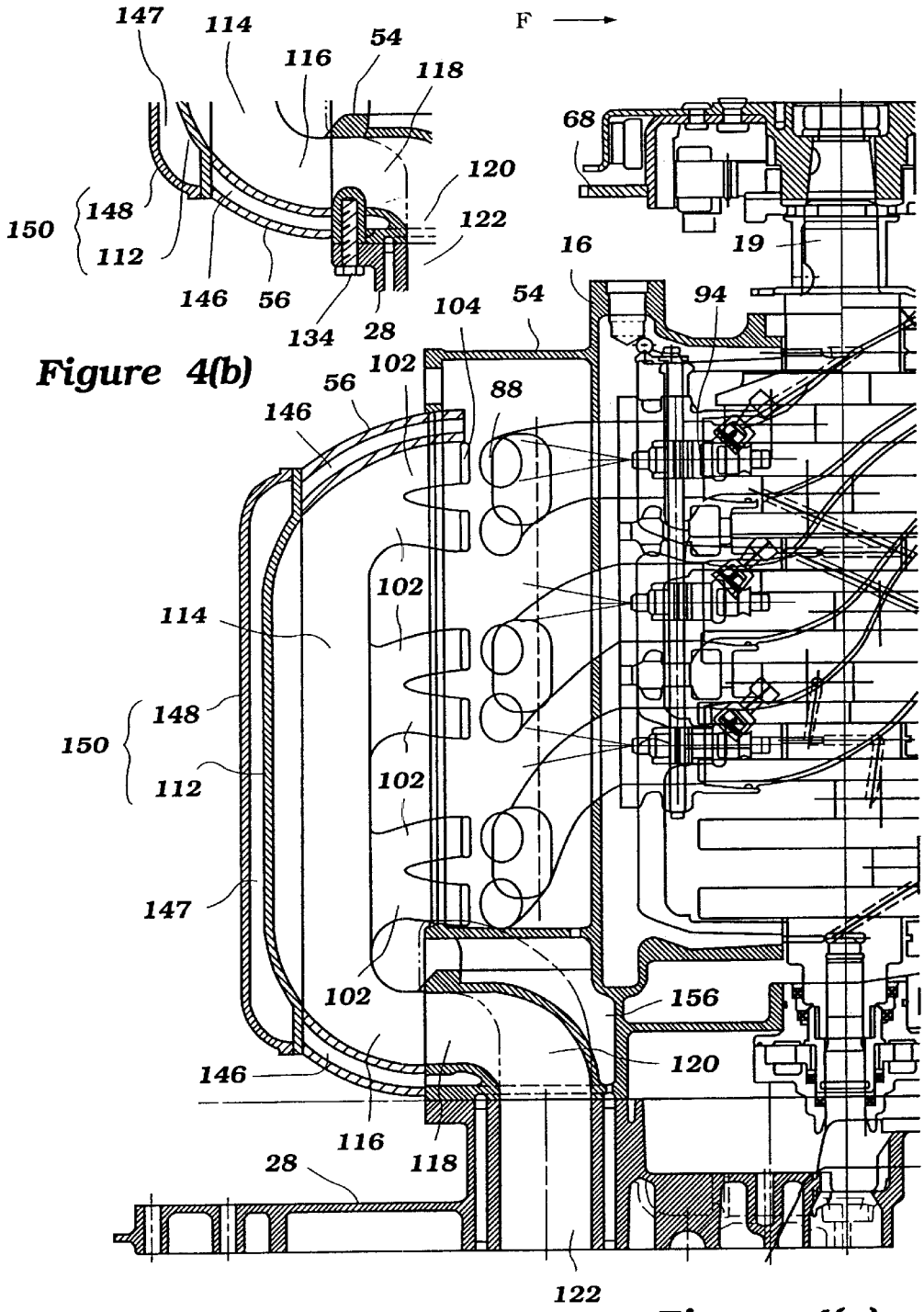
FIGS. 4*a* and 4*b* are sectioned side elevation views of the engine of the outboard motor of FIG. 1 shown in a wire frame format.
Figure 5:
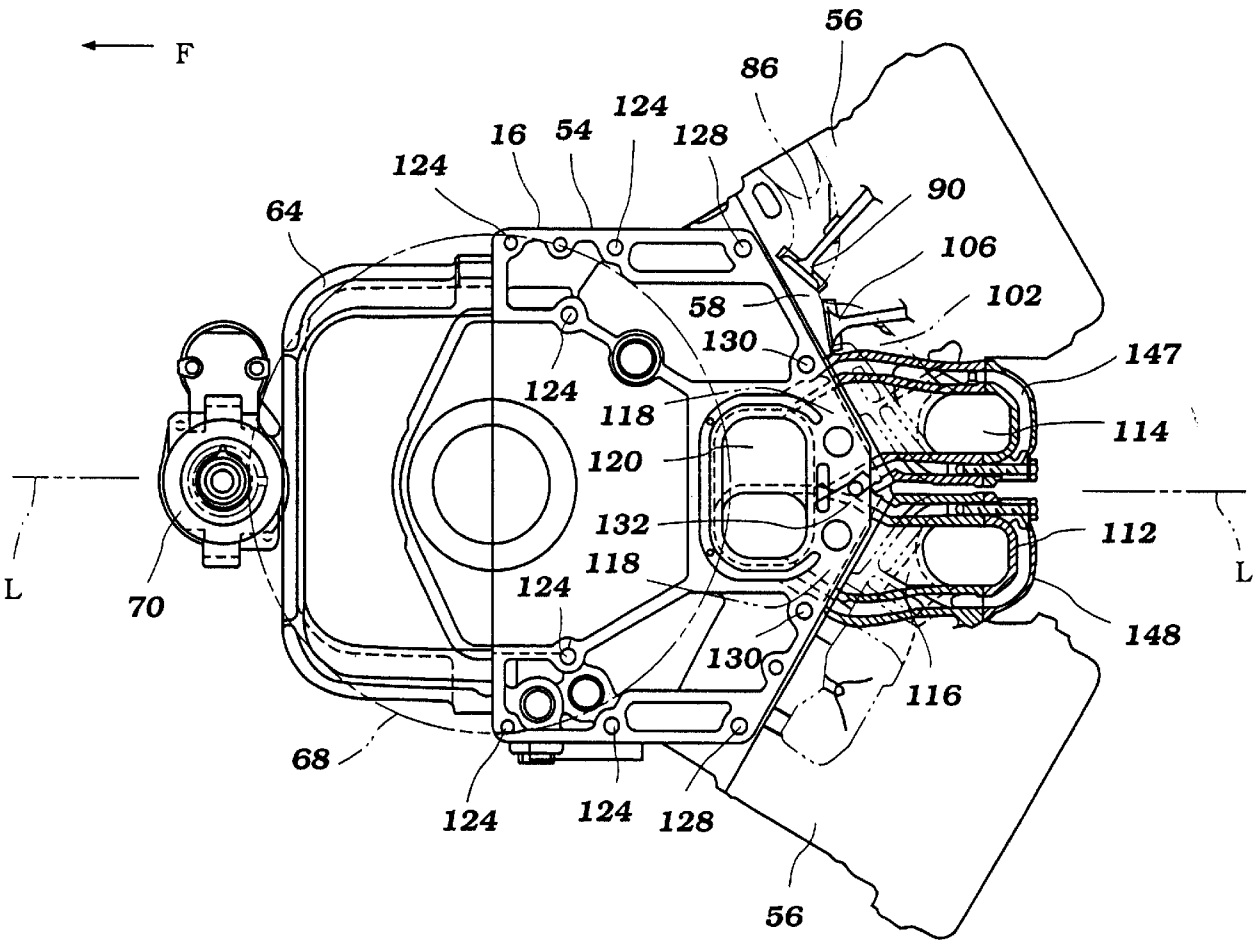
FIG. 5 is a partially sectioned top plan view of a mounting arrangement for the exhaust manifold between a pair of cylinder banks of the engine of the outboard motor of FIG. 1.
Figure 6:
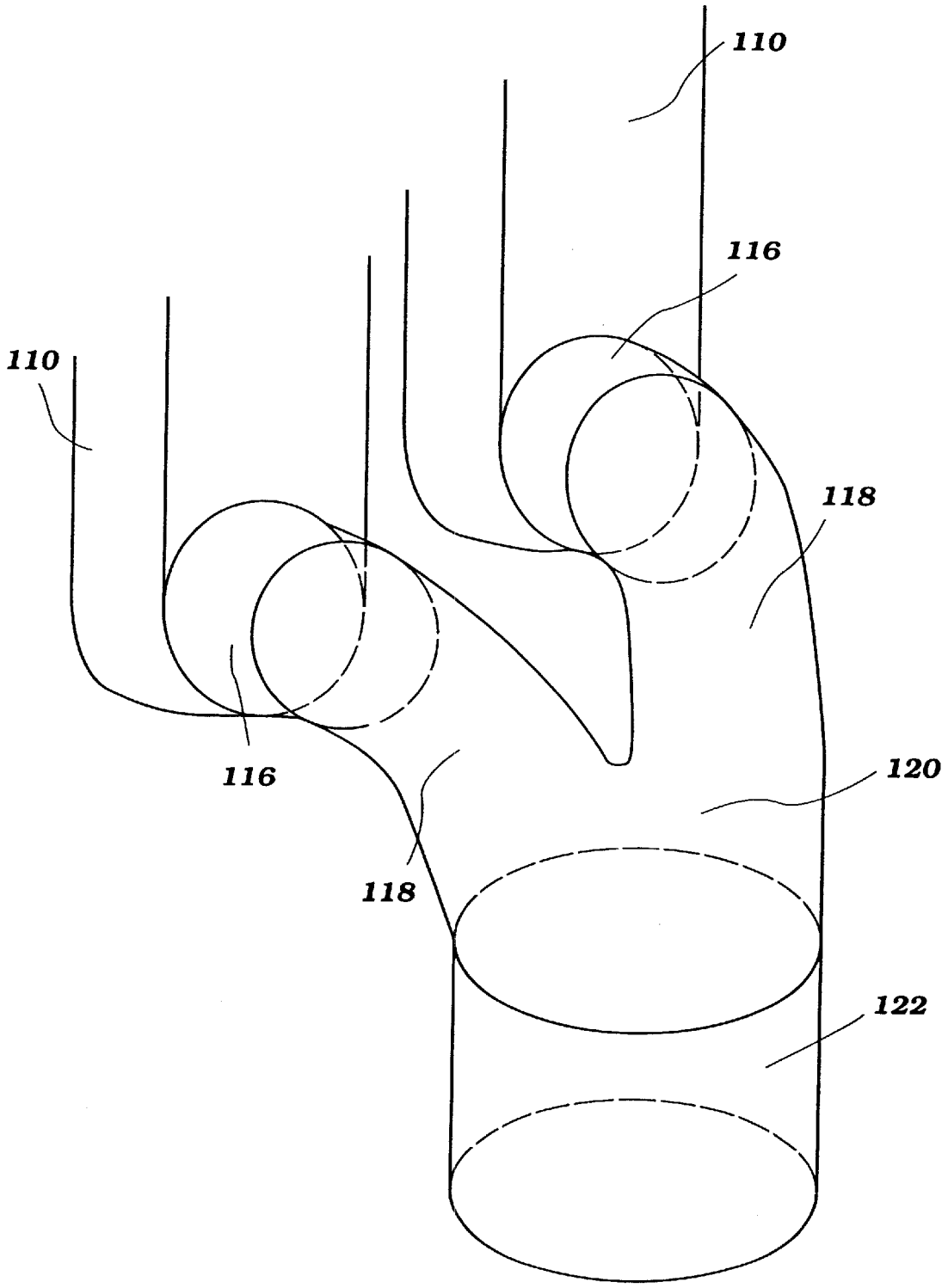
FIG. 6 is a schematic illustration of a portion of the exhaust system associated with the engine of outboard motor of FIG. 1.

With reference now to FIG. 4(*a*) and FIG. 6, the illustrated exhaust manifold 110 is in direct communication with a connecting passage 116. The connecting passage 116 extends forward from the illustrated exhaust manifold 110 toward the cylinder block 54. As illustrated, the connecting passage 116 is preferably formed within the cylinder head assembly 56. The connecting passage 116 transitions the exhaust flow from a generally vertical direction in the manifold into a generally longitudinal (i.e., horizontal and in fore and aft directions of the watercraft) exhaust flow at the exit of the manifold 110.

The connecting passages 116, in turn, are in direct communication with a pair of branch passage 118 formed in the cylinder block. The branch passages 118 transition the exhaust flow from a generally longitudinal direction into a generally vertical direction, as illustrated in FIG. 4(*a*). Additionally, the branches 118 merge into a single discharge passage 120 within the cylinder block 54.

The single discharge passage 120 has an increased diameter relative to the branches. Additionally, the discharge passage 120 is positioned within the cylinder block 54 at a location that falls beneath the illustrated flywheel 68. Preferably, the single discharge passage 120 is positioned along a central bisecting plane that extends in a generally vertical direction through the crankshaft or the driveshaft. In addition, the position places the discharge passage 120 and the starter motor 70 substantially equidistant from the crankshaft with the crankshaft interposed between the two components 120, 70. This positioning tucks the exhaust manifold and the associated discharge conduits between the cylinder banks while also making advantageous use of so-called dead space (i.e., otherwise unoccupied space) within the cylinder block 54.

The single discharge passage 120 is in direct communication with an exhaust passage 122 extending through the exhaust guide plate 28 in the illustrated motor 10. Because the discharge passage 120 consists of a single tube, or passage, in the illustrated arrangement, the juncture between the passage 120 and the passage 122 is easier to seal and the motor, therefore, is easier and less expensive to manufacturer than those introducing exhaust to the guide plate through separate passages. Desirably, the single discharge passage 120 and the exhaust passage 122 of the exhaust guide passage form a one-to-one piping connection.

From the exhaust passage 122 of the guide plate 28, the exhaust gases can be passed to a point external to the outboard motor using any suitable exhaust discharge components. For instance, the exhaust gases may be discharged into the body of water in which the watercraft is operating, such as by using a through-the-hub discharge arrangement. Such an arrangement advantageously silences and cools the exhaust gases being discharged.

With reference again to FIGS. 4(*b*) and 5, an arrangement for mounting the cylinder block 54 to the exhaust guide 28 will be described. The cylinder block features a plurality of holes 124 in the illustrated arrangement. In addition to these holes 124, a series of five bolt holes is positioned along the surfaces of the cylinder block 54 to which the cylinder head assemblies 56 are attached to the cylinder block 54. The series comprises a pair of corner bolt holes 128, a pair of intermediate bolt holes 130 and a central bolt hole 132. The corner holes 128 and the central hole 132 allow the cylinder block 54 and the exhaust guide 28 to be connected in at least three locations positioned along a rear edge of the cylinder block 54. Preferably, the said cylinder block is bolted to the exhaust guide 28 at two rear corners of the cylinder block 54 and in a position along a central bisecting plane extending in a generally vertical direction through the crankshaft or driveshaft. As illustrated in FIG. 4(*b*), a bolt or other fastener 134 is preferably used to affix the two together. Of course, a weld stud or the like and the two components 54 could replace the hole, 28 could be secure together using other suitable fastening arrangements and combinations.

Figure 7:
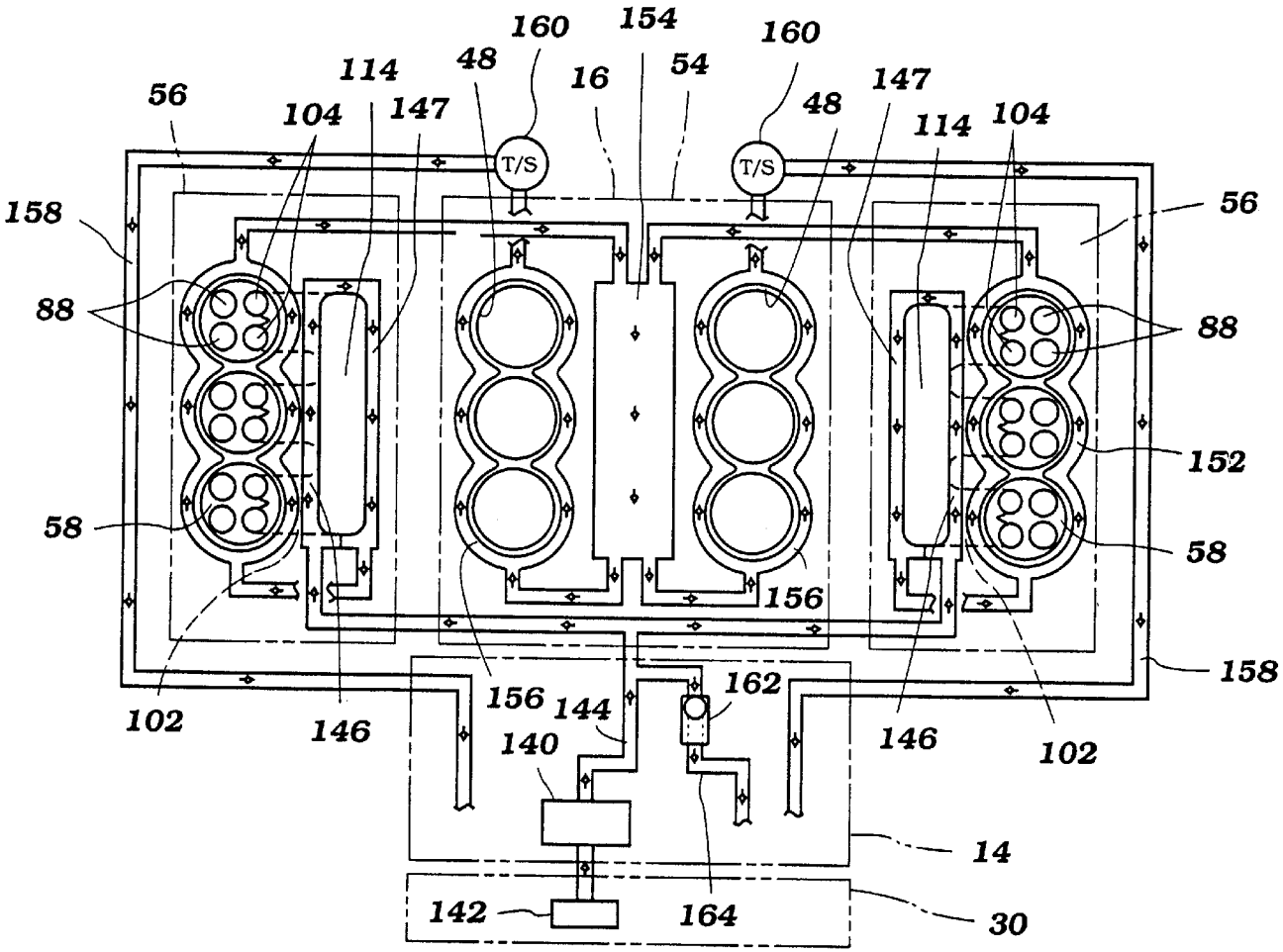
FIG. 7 is a flow diagram showing a coolant flow path through a cooling system employed in the outboard motor of FIG. 1.

With reference now to FIG. 7 initially, the present outboard motor 10 also comprises a cooling system that cools both the engine 16 and at least a portion of the exhaust system. As illustrated, the cooling system preferably picks up coolant from the body of water in which the watercraft is operating. Of course, a closed loop cooling system can also be used in some applications.

With reference now to FIGS. 1 and 7, the drive shaft 32 drives a water pump 140 that preferably is positioned within the drive shaft housing 14. The pump 140 preferably draws water through an inlet port 142 formed in the lower unit 30. This water is delivered to the engine 16 in a manner that will now be described.

The cooling water flows up toward the engine through a coolant passage 144 through the drive shaft housing. The coolant passage 144 then feeds a pair of parallel cooling jackets formed around the runners of the exhaust manifold 102. From the runner cooling jacket 146, the cooling water circulates through an exhaust manifold exhaust passage 114. With reference now to FIGS. 3, 4(*a*) and 6, the exhaust manifold cooling jackets 147 are formed between an inner wall (i.e., the manifold cover 112) and an outer wall 148. Together, the outer wall 148 and the manifold cover 112 form a manifold cap or lid 150 in the illustrated engine 16. Because the exhaust manifold is cooled first, the opportunity exists to rapidly cool the exhaust flow. By cooling the exhaust flow, the volume of the exhaust flow can be decreased. In addition, cooling the exhaust flow lowers the speed of sound and can alter the propagation of sound waves within the exhaust system as will be recognized by those of ordinary skill in the art.

The exhaust manifold cooling jackets 146 communicate with cylinder head cooling jackets 152 as illustrated in FIG. 7. As illustrated, these cylinder head cooling jackets 152 circulate the coolant about the combustion chambers 58, among other components The coolant then circulates through a V-bank jacket 154 formed between the cylinder banks 50, 52. From the V-bank jacket 154, the water flows up through a cylinder jacket 156 and down through an exit passage 158. Thus, the cooling water is circulated from the bottom to the top of the engine three times.

A thermostat 160 preferably is positioned near the end of the coolant path of each cylinder bank 50, 52 for monitoring the temperature of the coolant. A control valve (not shown) also can be positioned in the coolant path of each cylinder bank 50, 52 and can be controlled by the thermostat or a CPU depending upon the application. For instance, if the coolant temperature is high, the valve can be opened to allow coolant to flow through the engine at a high rate. On the other hand, if the temperature of the coolant is low, then the valve can be closed to allow the engine to warm up.

Preferably, a relief valve 162 is provided near the pump to divert coolant through a relief passage 164 in the event that the coolant pressure exceeds a predetermined high pressure. This relief valve 162 can be any suitable pressure regulator or pressure regulating valve configuration. In addition, the relief valve 162 can be replaced by suitable sensors and CPU controlled valves or the like.

Although this invention has been described in terms of a certain preferred embodiment, other embodiments apparent to those of ordinary skill in the art are also within the scope of this invention. In addition, not all features, aspects or advantages of the present invention are necessarily required to practice certain portions of the present invention. Accordingly, the scope of the invention is intended to be defined only by the claims that follow.

What is claimed is:

1. An outboard motor comprising an internal combustion engine, an exhaust guide plate being positioned generally below said internal combustion engine and comprising an exhaust guide passage, said internal combustion engine comprising a generally vertically extending crankshaft and a cylinder block comprising a first cylinder bank and a second cylinder bank, said first cylinder bank and said second cylinder bank being inclined relative to each another, said first cylinder bank comprising a first lower cylinder and said second cylinder bank comprising a second lower cylinder, a first cylinder head assembly enclosing said first lower cylinder and a second cylinder head assembly enclosing said second lower cylinder, said first cylinder head assembly comprising a first exhaust port and a first exhaust runner corresponding to said first lower cylinder and said second cylinder head assembly comprising a second exhaust port and a second exhaust runner corresponding to said second lower cylinder, said first exhaust runner extending between said first exhaust port and a first generally vertically extending exhaust manifold, said second exhaust runner extending between said second exhaust port and a second generally vertically extending exhaust manifold, a first connecting exhaust conduit communicating with said first exhaust manifold and a second connecting exhaust conduit communicating with said second exhaust manifold, said first connecting exhaust conduit extending toward said cylinder block and joining a first end of a first passage formed within said cylinder block, said second connecting exhaust conduit extending toward said cylinder block and joining a first end of a second passage formed within said cylinder block, said first end of said first passage being disposed vertically higher on said cylinder block than said first end of said second passage, said first and second passages merging within said cylinder block into an exhaust discharge, and said exhaust discharge being coupled to said exhaust guide passage.

2. The outboard motor of claim 1, wherein said first exhaust manifold and said second exhaust manifold extend generally vertically within a valley defined by a first surface of said first cylinder bank and a second surface of said second cylinder bank.

3. The outboard motor of claim 1, wherein said first exhaust manifold is formed in two separable components that are mechanically fastened together.

4. The outboard motor of claim 3, wherein one of said two components comprises a manifold cap and a coolant passage is formed within said manifold cap.

5. An outboard motor comprising an internal combustion engine, an exhaust guide plate being positioned generally below said internal combustion engine and comprises an exhaust guide passage, said internal combustion engine comprising a generally vertically extending crankshaft and a cylinder block having a pair of cylinder banks inclined relative to one another, each of said pair of cylinder banks including at least one cylinder and a corresponding exhaust port, an exhaust runner being in selective communication with each exhaust port, said engine comprising two exhaust manifolds that extend in generally vertical directions, said cylinder block also having a pair of passages formed therein that are in communication with said exhaust manifolds, said passages merging within said cylinder block into an exhaust discharge, and said exhaust discharge being in communication with said exhaust guide passage, said engine further comprising a flywheel attached to said crankshaft and having an outer diameter, said exhaust discharge of said cylinder block being positioned within said cylinder block such that said outer diameter overlaps at least a portion of said exhaust discharge when viewed from the top.

6. The outboard motor of claim 5, wherein said exhaust discharge is formed vertically lower than axes of said cylinders.

7. The outboard motor of claim 6, wherein said exhaust discharge is positioned generally between said cylinder banks.

8. The outboard motor of claim 7, wherein said engine further includes at least one water jacket and said exhaust manifolds are partially defined by at least one cover including said water jacket.

9. The outboard motor of claim 8, wherein said outboard motor includes a propulsion unit and a shaft that rotates at least a portion of said propulsion unit and that is powered by said crankshaft, said exhaust discharge being positioned along a central bisecting plane extending in a generally vertical direction through said shaft.

10. The outboard motor of claim 8, wherein said exhaust manifold is defined by at least one exhaust manifold cap that is positioned to a rear facing side of said engine.

11. The outboard motor of claim 8, wherein said cylinder block further comprises two rear corners and said cylinder block and said exhaust guide are bolted together at said two rear corners and in a position along a central bisecting plane extending in a generally vertical direction through said crankshaft.

12. The outboard motor of claim 8, wherein a juncture of said exhaust discharge and said exhaust guide passage is sealed.

13. The outboard motor of claim 12, wherein said juncture between said exhaust discharge and said exhaust guide passage consists of a one-to-one piping connection.

14. An outboard motor comprising a first cylinder bank and a second cylinder bank, said first cylinder bank and said second cylinder bank being inclined relative to one another and jointly forming at least a portion of a cylinder block, a crankcase cover connected to a portion of said cylinder block and at least partially defining a crankcase chamber, a generally vertically extending crankshaft extending through said crankcase chamber between said crankcase cover and said cylinder block, a first cylinder head assembly being attached to said first cylinder bank and a second cylinder head assembly being attached to said second cylinder bank, a first exhaust manifold being connected to said first cylinder head assembly, a second exhaust manifold being connected to said second cylinder head assembly, an exhaust passage being formed in said cylinder block and comprising a first branch, a second branch and a convergent portion that combines said first branch and said second branch, and said first and second exhaust manifolds separately communicating with said first and second branches respectively, said first and second exhaust manifolds communicating with said first and second branches, and said first and second exhaust manifolds being at least partially formed in said first and second cylinder head assemblies respectively, wherein said first and second exhaust manifolds also are at least partially defined by a first exhaust manifold cap and a second exhaust manifold cap.

15. The outboard motor of claim 14, wherein said first exhaust manifold cap and said second exhaust manifold cap each includes a cooling jacket extending therethrough.

16. The outboard motor of claim 14, wherein said first and second exhaust manifolds are positioned between said first and second cylinder head assemblies.

17. The outboard motor of claim 14, wherein said first exhaust manifold and said second exhaust manifold extend generally vertically within a valley defined by a first surface of said first cylinder bank and a second surface of said second cylinder bank.

18. The outboard motor of claim 14, wherein said first exhaust manifold is formed in two separable components that are mechanically fastened together.

19. An outboard motor comprising a first cylinder bank and a second cylinder bank, said first cylinder bank and said second cylinder bank being inclined relative to one another and jointly forming at least a portion of a cylinder block, a crankcase cover connected to a portion of said cylinder block and at least partially defining a crankcase chamber, a generally vertically extending crankshaft extending through said crankcase chamber between said crankcase cover and said cylinder block, a flywheel attached to an upper end of said crankshaft, said flywheel having an outer diameter, a first cylinder head assembly being attached to said first cylinder bank and a second cylinder head assembly being attached to said second cylinder bank, a first exhaust manifold being connected to said first cylinder head assembly, a second exhaust manifold being connected to said second cylinder head assembly, an exhaust passage being formed in said cylinder block and comprising a first branch, a second branch and a convergent portion that combines said first branch and said second branch, said cylinder block exhaust passage being positioned such that said outer diameter overlaps at least a portion of said cylinder block exhaust passage when viewed from the top of the motor, said first and second exhaust manifolds separately communicating with said first and second branches respectively, said first and second exhaust manifolds communicating with said first and second branches, and said first and second exhaust manifolds being at least partially formed in said first and second cylinder head assemblies respectively.

20. The outboard motor of claim 19, wherein said first exhaust manifold and said second exhaust manifold extend generally vertically within a valley defined by a first surface of said first cylinder bank and a second surface of said second cylinder bank.

21. The outboard motor of claim 19, wherein said first exhaust manifold is formed in two separable components that are mechanically fastened together.

22. An outboard motor comprising a starter motor, a first cylinder bank and a second cylinder bank, said first cylinder bank and said second cylinder bank being inclined relative to one another and jointly forming at least a portion of a cylinder block, a crankcase cover connected to a portion of said cylinder block and at least partially defining a crankcase chamber, a generally vertically extending crankshaft extending through said crankcase chamber between said crankcase cover and said cylinder block, a flywheel being connected to said crankshaft and said starter motor selectively driving said flywheel, a first cylinder head assembly being attached to said first cylinder bank and a second cylinder head assembly being attached to said second cylinder bank, a first exhaust manifold being connected to said first cylinder head assembly, a second exhaust manifold being connected to said second cylinder head assembly, an exhaust passage being formed in said cylinder block and comprising a first branch, a second branch and a convergent portion that combines said first branch and said second branch, said crankshaft being interposed between said cylinder block exhaust passage and said starter motor, a distance between said crankshaft and said starter motor being substantially the same as a distance between said crankshaft and said cylinder block exhaust passage when viewed from the top of the motor, said first and second exhaust manifolds separately communicating with said first and second branches respectively, said first and second exhaust manifolds communicating with said first and second branches, and said first and second exhaust manifolds being at least partially formed in said first and second cylinder head assemblies respectively.

23. The outboard motor of claim 22, wherein said first exhaust manifold and said second exhaust manifold extend generally vertically within a valley defined by a first surface of said first cylinder bank and a second surface of said second cylinder bank.

24. The outboard motor of claim 22, wherein said first exhaust manifold is formed in two separable components that are mechanically fastened together.

25. An outboard motor comprising a first cylinder bank and a second cylinder bank, said first cylinder bank and said second cylinder bank being inclined relative to one another and jointly forming at least a portion of a cylinder block, a crankcase cover connected to a portion of said cylinder block and at least partially defining a crankcase chamber, a generally vertically extending crankshaft extending through said crankcase chamber between said crankcase cover and said cylinder block, a first cylinder head assembly being attached to said first cylinder bank and a second cylinder head assembly being attached to said second cylinder bank, a first exhaust manifold being connected to said first cylinder head assembly, a second exhaust manifold being connected to said second cylinder head assembly, an exhaust passage being formed in said cylinder block and comprising a first branch, a second branch and a convergent portion that combines said first branch and said second branch, and said first and second exhaust manifolds separately communicating with said first and second branches respectively, said first and second exhaust manifolds communicating with said first and second branches, and said first and second exhaust manifolds being at least partially formed in said first and second cylinder head assemblies respectively, wherein a lowermost cylinder of said first cylinder bank and an inlet to said first branch are separated by approximately the same distance as a lowermost cylinder of said second cylinder bank and an inlet to said second branch.

26. The outboard motor of claim 25, wherein said first exhaust manifold and said second exhaust manifold extend generally vertically within a valley defined by a first surface of said first cylinder bank and a second surface of said second cylinder bank.

27. The outboard motor of claim 25, wherein said first exhaust manifold is formed in two separable components that are mechanically fastened together.

* * * * *